United States Patent [19]

Jackson

[11] Patent Number: 4,625,653

[45] Date of Patent: Dec. 2, 1986

[54] HIGH ADHESION RAILWAY POWER TRUCK WITH BODY SPRING-SUPPORTED ON THE TRUCK STRUCTURE

[75] Inventor: Keith L. Jackson, Creve Coeur, Mo.

[73] Assignee: Lukens General Industries, Inc., Coatesville, Pa.

[21] Appl. No.: 753,934

[22] Filed: Jul. 11, 1985

[51] Int. Cl.[4] ..... B61F 5/24

[52] U.S. Cl. ..... 105/168; 105/182.1; 105/199.1

[58] Field of Search ..... 105/167, 168, 171, 182 R, 105/199 R, 199 F, 200, 202, 208, 199 A, 157 R, 185

[56] References Cited

U.S. PATENT DOCUMENTS

| | | | |
|---|---|---|---|
| 2,219,360 | 10/1940 | Green | 105/200 |
| 2,242,422 | 5/1941 | Eksergian | 105/182 R |
| 3,557,709 | 1/1971 | Hilfing | 105/199 |
| 3,693,553 | 9/1972 | Lich | 105/199 F |
| 3,884,157 | 5/1975 | Pelgbon | 105/182 R |
| 4,075,950 | 2/1978 | Marta et al. | 105/182 R |
| 4,231,296 | 11/1980 | Jackson | 105/199 R |
| 4,480,553 | 11/1984 | Scheffel | 105/182 R |

FOREIGN PATENT DOCUMENTS

| | | | |
|---|---|---|---|
| 3119164 | 12/1982 | Fed. Rep. of Germany | 105/168 |

*Primary Examiner*—Robert B. Reeves
*Assistant Examiner*—Dennis C. Rodgers
*Attorney, Agent, or Firm*—F. Travers Burgess

[57] ABSTRACT

A railway power truck has a rigid frame resiliently supported on its axles and intermediate its axles has a bolster supported on the sides of the rigid frame by longitudinally oppositely inclined elastomeric pads whose normals converge near rail level. At the sides of the truck, the bolster mounts springs which directly support the vehicle body and are yieldable horizontally as well as vertically to accommodate swivel and lateral movements of the body with respect to the truck. For transmitting longitudinal tractive and braking forces between the truck and body and preventing tipping of the bolster about a transverse axis with respect to the body while accommodating lateral and swivel movements of the body with respect to the bolster, while providing clearance at the level of the truck frame for structure such as radial axle linkage, the body rigidly mounts at the center of the truck a depending cylindrical post and the post swivelly mounts a generally diagonally extending lever, to the opposite ends of which are pivotally secured vertically spaced pairs of parallel longitudinally extending links, the links at opposite ends of the lever extending in opposite longitudinal directions and being pivotally connected at their ends remote from the lever to the bolster, thus maintaining the bolster parallel to the body irrespective of longitudinal tipping movements of the truck frame, the latter being accommodated by the inclined bolster mounting pads whereby to cause transmission of tractive forces to the body effectively at rail level and thereby minimize axle-to-axle load transference.

21 Claims, 4 Drawing Figures

HIGH ADHESION RAILWAY POWER TRUCK WITH BODY SPRING-SUPPORTED ON THE TRUCK STRUCTURE

BACKGROUND OF THE INVENTION

1. Field of the Invention:

The invention relates to railway rolling stock and consists particularly in a railway highadhesion power truck directly supporting the body on truck-mounted springs yieldable in shear longitudinally of the truck to accommodate swivel movements of the truck with respect to the body.

2. The Prior Art:

In my U.S. Pat. No. 3,799,066, the frame of a railway motor truck swivelly mounts a sub-bolster by means of mating cylindrical members and longitudinally spaced side bearings, the sub-bolster mounts a main bolster by means of elastomeric pads inclined longitudinally of the truck such that their normals intersect near rail level, the main bolster carries upright coil springs directly supporting the car body and the main bolster is connected at each side by vertically spaced longitudinally extending parallel links to a bracket depending from the body for transmitting longitudinal forces between the truck and the body and preventing tipping movements of the main bolster longitudinally with respect to the body. Richard L. Lich U.S. Pat. No. 3,651,766 and my U.S. Pat. No. 4,134,343 disclose the use of a generally transverse lever fulcrumed to the car body on a vertical axis, with a single longitudinal link extending from each end of the lever to the truck to transmit draft and braking forces between truck and body.

SUMMARY OF THE INVENTION

A primary object of the invention is to provide a high adhesion railway power truck in which swivel and draft connections to a supported vehicle body are at a level sufficiently high to clear truck mounted structure such as steering linkages.

A further object is to provide a truck similar to that of my U.S. Pat. No. 3,799,066 in which the sub-bolster and its swivel connection to the truck frame as well as its anti-tipping support on the truck frame are eliminated and swivel movements of the truck with respect to the body are accommodated by horizontal shear in the body support springs.

A further object is to provide the above described swivel and draft connections to a self-steering radial axle truck in which the axle boxes at the respective sides of the truck are connected by a Z-linkage comprising a substantially upright lever intermediate the axles and links connecting the respectively opposite ends of each lever with the axle boxes at the respective side of the truck, the normally upright levers being secured to the ends of a transverse shaft journaled in beams supported from the axle boxes, whereby to maintain the axles in parallelism on tangent track while permitting equal and opposite turning movements of the axles in the horizontal plane on curved track.

The above objects are attained by mounting the inclined bolster support elastomeric pads directly on the truck frame, supporting the main bolster directly on the elastomeric pads and connecting the main bolster at each side of the truck by vertically spaced pairs of parallel longitudinally extending links to a generally transverse lever pivotally connected on a vertical axis to the vehicle body, swivel movements of the bolster and other truck structure with respect to the body being accommodated by pivotal movements of the lever, vertical and lateral movements of the body with respect to the truck being accommodated by the pivotal connections of the links to the truck bolster and the lever, and relative tipping movements of the bolster about a transverse axis relative to the body being substantially prevented by the parallel longitudinal links.

DETAILED DESCRIPTION OF THE INVENTION

Figure 1:
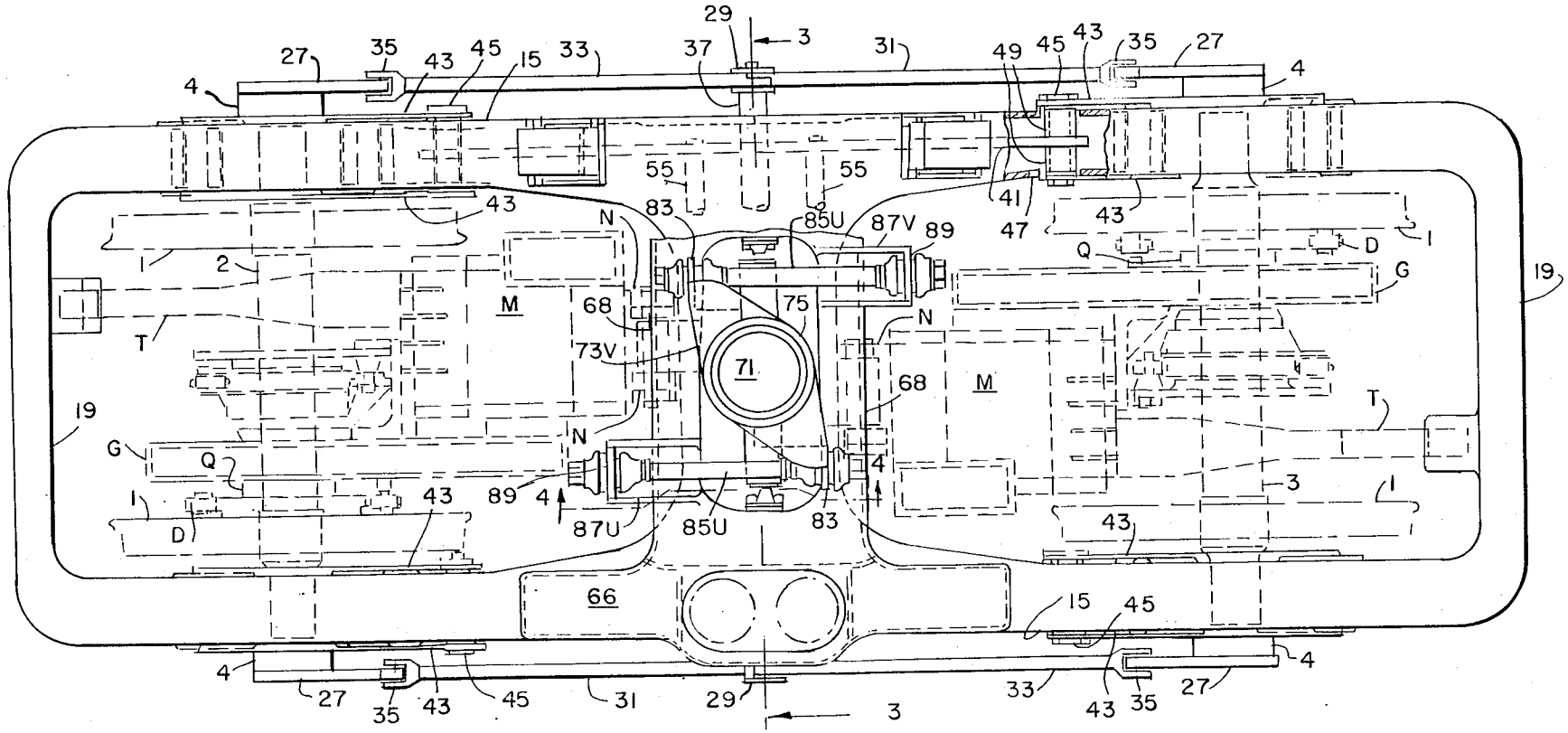
FIG. 1 is a plan view of a truck embodying the invention.
Figure 2:
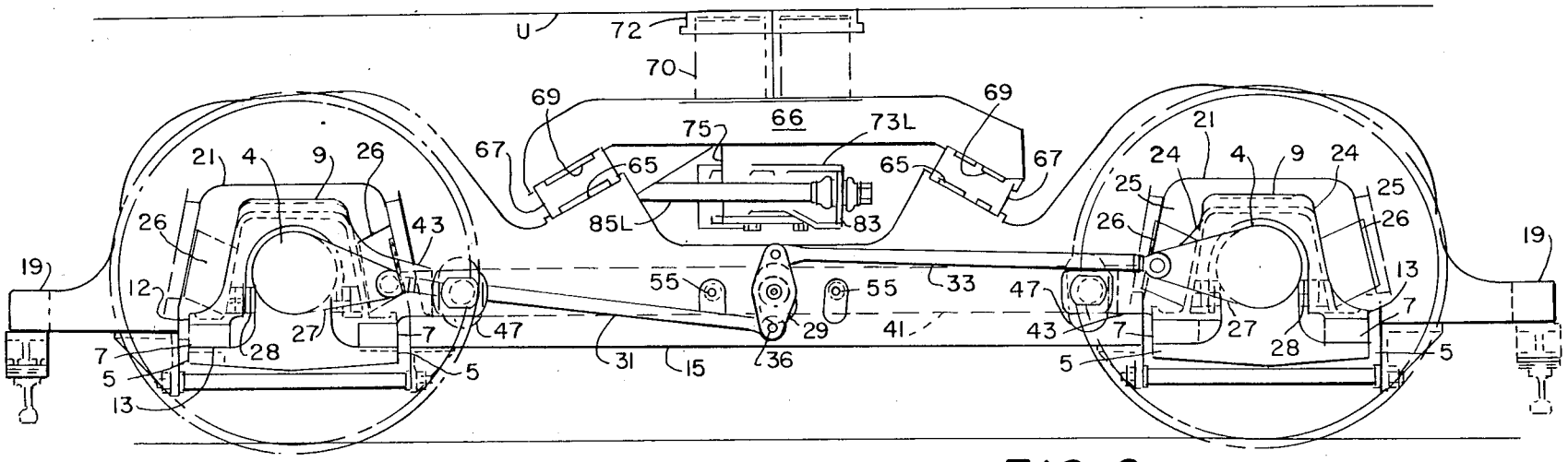
FIG. 2 is a side elevational view of the truck illustrated in FIG. 1.
Figure 4:
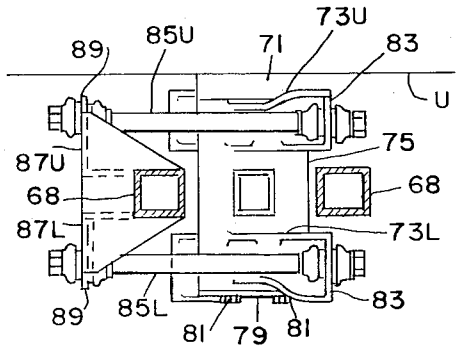
FIG. 4 is a longitudinal vertical sectional view taken along the line 4—4 of FIG. 1.

The truck illustrated in the drawings has a pair of spaced wheel and axle assemblies, each comprising railway flanged wheels 1 mounted in gauged pairs on the ends of the respective axles 2 and 3. The effective conicity of the wheel tread profiles 1*a* is sufficient to affect self-steering of each wheel and axle assembly by means of the differential effect between the rail-contacting wheel diameters of the outer and inner wheels on curved track and is substantially greater than the standard wheel thread conicity of 1:20 or 0.05, preferably being between 1:10 and 1:5. Journal bearing boxes 4 are mounted on the projecting journal portions of axles 2 and 3 and are formed with longitudinally projecting wings 5 on which are seated flat elastomeric pad devices 7, and generally inverted U-shaped yokes 9 embracing journal boxes 4 have their downwardly facing terminals 13 supported on pads 7.

A truck frame comprises longitudinally extending side members 15 connected at their midpoints by transverse center transom 17 and at their ends by transverse end transoms 19. Each side member 15 has at its ends downwardly open pedestal openings 21 embracing yokes 9.

The sides 25 of the respective pedestal openings 21 are inclined toward each other longitudinally of the truck and the outer surfaces 24 of the yokes 9 are similarly inclined and are both flat, and flat elastomeric and metal pad devices 26 are interposed between the respective concave and convex surfaces to provide a vertically yieldable support for the truck frame 15, 17 for cushioning the truck frame against shocks received from the track rails and maintaining the respective wheels 1 in full engagement with the track rails irrespective of vertical irregularities in the latter. Lateral stops 28 are provided between journal boxes 4 and yokes 9 to oppose relative lateral movement between these elements, longitudinal movements of boxes 4 relative to yokes 9 and frame 15, 17 required for steering being accommodated by shear in pads 7 and necessary transverse movements of boxes 4 relative to the frame being accommodated by transverse shear in pads 26.

For maintaining the longitudinal spacing of the wheel and axle assemblies 1, 2 and 1, 3 and maintaining them in parallelism, as well as for opposing hunting movements of the wheel and axle assemblies during movement along tangent track and for coupling wheel-induced turning movements of the wheel and axle assemblies in the horizontal plane in opposite directions on curved track so as to avoid interference with their self-steering ability, journal bearing boxes 5 at each side of the truck rigidly mount mounting paddles 27. Longitudinally extending links 31 and 33 are pivotally connected at their opposite ends to mounting paddles 27 by clevises and pins 35 and by pins 36 to the opposite ends of upright levers 29 fixed to the ends of a transverse shaft 37 rotatably journaled at 39 in beams 41 on truck frame side members 15 intermediate the axles. The links 33 connected to the upper ends of levers 29 at opposite sides of the truck are connected at their opposite ends to different axles; i.e., link 33 at one side is connected to mounting paddle 27 on axle bearing box 5 on axle 2, and link 33 on the other side is similarly connected to axle 3, the axle connections of bottom links 31 being correspondingly reversed. It will be evident that wheel-induced yawing movements of the axles in opposite senses will be freely accommodated by the coupling interconnection comprising Z-linkages 29, 31, 33 and shaft 37 because movement of the inner ends of axles 2 and 3 toward each other on curved track will be accompanied by corresponding movement away from each other of the outer ends of the axles and the foreshortening of the inner Z-linkage will be accompanied by extension of the outer Z-linkage by reason of the alternate rotation of shaft 37. At the same time, any tendency of the wheels of either axle to hunt will be opposed by the interconnection with the other axle.

It will also be evident that by reason of the location of Z-linkages 29, 31, 33 outboard of the truck frame side members, the space between the wheels is unobstructed by the axle-to-axle coupling, thus freeing this space for motors and drive mechanism.

To provide a support for Z-link shaft 37 which passes through transom 17, unaffected by vertical movements of the truck frame, a longitudinally extending beam 41 is positioned within box section frame side members 15 and is directly supported from the respective yokes 9 by arms 43 on the yokes 9 inboard and outboard of the side members 15. Arms 43 are connected by transverse pins 45 extending through appropriate holes 47 in the inner and outer walls of the truck frame side members 15 and cylindrical sleeve-like spacers 49 are mounted on pins 45 for maintaining the beams 41 centered transversely between arms 43 on yokes 9. Shaft 37 is journaled in beams 43 at the centers thereof and the outer walls of the frame side members are formed with central vertically elongated apertures 51 which permit the passage therebetween of shaft 37 and accommodate vertical movements of the frame resulting from the resilient support of the frame on yokes 9 with respect to shaft 37. For preventing relative movements of beams 41 in the horizontal plane while permitting relative tilting movements of the beams 41 in their respective vertical planes as may be required by relative vertical movements of journal box-yoke assemblies 4, 9, beams 41 are tied to each other by means capable of flexing in longitudinal vertical planes, while remaining rigid in the horizontal plane, exemplified by longitudinally spaced transversely extending tubes 55 secured at their opposite ends to opposite beams 41. From the foregoing description, it will be seen that since vertical movement of yokes 9 on journal boxes 4 is resisted by the high resistance to compression of elastomeric pads 7 by which the yokes are supported from the journal boxes, there will be virtually no vertical movement between shaft-supporting beam 41 and the journal boxes, while the pin connection of shaft supporting beam 41 to yoke arms 27 will prevent any longitudinal movement of beams 41 with respect to the associated yokes,and tubes 55 prevent relative lateral movement between beams 41, thereby preventing any parasitic vertical motion of the Z-linkages with respect to the journal boxes and consequent parasitic longitudinal movements of the journal boxes to which the links are connected.

Instead of the conventional axle hung motors with their noses resiliently supported on the center transom, and the attendant disadvantages of such motor suspensions including pitch of the truck frame about a transverse axle resulting from oppositely directed vertical torque reactions on the frame, and the inertia of the axles resulting from the motor load, which would resist wheel-induced steering movements, the traction motors M are supported by double noses N on brackets projecting toward the axles from center transom 17 and by motor torque arm T extending over the adjacent axle and secured to adjacent end transom 19, noses N and torque arm T being rigidly secured to shelf 45 and end transom 18 by suitable means such as bolts B.

To accommodate vertical movements of frame-supported motor M with respect to axles 2 and 3 and yawing movements of the respective axle, the motors M rotatably mount a sleeve or quill surrounding the respective axle and of sufficiently larger inside diameter than the diameter of the axle to clear the axle. Quill Q is drivingly connected to motor M by gears (not shown) in gear box G, and drives wheels 1 through flexible driving connections D.

For resiliently supporting the vehicle body, transmitting draft and braking forces from the truck thereto and accommodating truck swivel, each truck frame side member 15 is formed with upwardly facing longitudinal sloping surfaces 65, the normals to which intersect in the region of the intersection of the transverse center plane of the truck with the track rails. A bolster having longitudinally extending side members 66 connected by longitudinally spaced transverse members 68 is supported on frame 15, 17 by flat elastomeric pads 67 interposed between sloping frame surfaces 65 and correspondingly sloping downwardly faces 69 on bolster side members 66, such that the effective level of transmission of tractive forces from the truck to the vehicle body is at or near the rail when bolster 66, 68 is held against tipping relative to the body underframe U and has a draft connection thereto.

At its sides, bolster 66, 68 supports upwardly extending coil springs 70, which in turn support locomotive body underframe U by means of spring caps 72. For transmitting traction and braking forces from bolster 66, 68 to underframe U while accommodating vertical lateral and swivel movements between underframe U to bolster 66, 68, a cylindrical post 71 depends from underframe U at the center of the truck; i.e., substantially at the center of the space defined by bolster side members 66 and transverse members 68. A generally transversely disposed lever 73 comprising upper and lower parts 73U and 73L has a vertically elongated hub 75 swivelly mounted on post 71 by vertically spaced bearings 77 and is supported against vertical movement on post 71 by supporting plate 79 fixedly secured by nuts 81 or equivalent means to the lower end of post 71. The opposite ends of levers 73U and 73L are formed with upright webs 83 disposed transversely of the truck which are separately apertured to permit the connection thereto of transversely spaced pairs of vertically spaced longitudinally extending anchor links 85U and 85L which may be of the type disclosed in James C. Travilla U.S. Pat. No. 3,315,555. Bolster transverse members 68 are each formed with a double bracket 87U and 87L having transverse webs 89 apertured in longitudinal alignment with the apertures in lever webs 83 to permit the connection thereto of the ends of links 85U and 85L remote from their connections to lever webs 83. It will be evident from the foregoing that during operation of the locomotive, traction forces will be transmitted from the truck frame 13, 17 to bolster 66, 68, via inclined pads 67 and from the bolster transverse members 68 via longitudinally extending anchor links 85U and 85L to lever 73U, 73L. Since the latter is held against pivotal movements about a transverse axis with respect to the body underframe U by means of the vertically spaced bearings 77 between lever hub 75 and body mounted post 71, bolster 66, 68 is continuously restrained against tipping with respect to underframe U, and traction forces received by the bolster are transmitted directly to underframe U through links 85U and 85L, which also accommodate relative vertical and lateral movements of underframe U on bolster 66, 68 permitted by axial and transverse shear deflection in body support springs 70.

For limiting lateral movements of the underframe with respect to the truck bolster 66, 68, the side members thereof are provided with inwardly facing elastomeric bumpers 91 transversely spaced from and engageable with opposing surfaces on the outer ends of arms 93 projecting transversely from lever hub 75.

Additionally, the swivel mounting of lever 73U, 73L on post 71 accommodates swivel of the truck and bolster 66, 68 relative to the underframe and accommodated by generally longitudinal horizontal shear in body support springs 70.

Figure 3:
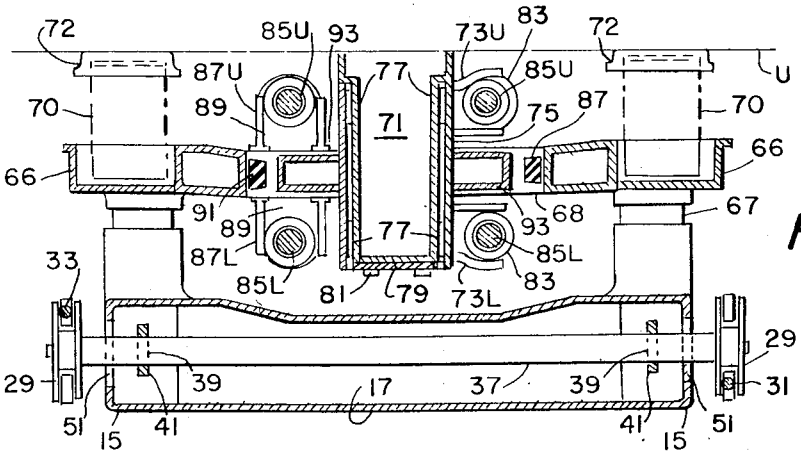
FIG. 3 is a partial transverse vertical sectional view taken along line 3—3 of FIG. 1.

In addition to the effectiveness of the lever and anchor connection of the bolster to the underframe for transmitting draft and braking forces while accommodating lateral vertical and swivel movements between the bolster and the underframe, it will be evident, particularly from FIG. 3, that ample clearance is provided for steering linkage structure, such as shaft 37, as compared with trucks of the prior art in which a plate or pivot member would extend from the bolster into a mating recess in truck frame transom 17.

Operation of the invention is as follows: As the truck is propelled along the track by traction motors M and their connections to axles 2 and 3, traction forces are transmitted to the truck frame from journal boxes 4 by links 31, 33, lever 29, beams 41, pins 45, yoke arms 43, yokes 9 and pad devices 26. The frame transmits traction forces via inclined pads 67 into bolster 66, 68, pads 67 accommodate tipping of the frame with respect to the bolster and cause the effective level of traction transmission to be near rail level because of the inclination of pads 67. Springs 70 mounted on bolster side members 66 and directly supporting underframe U via spring caps 72 deflect vertically and in horizontal shear to cushion the vehicle body against vertical and lateral forces acting on the bolster 66, 68. Links 85U and 85L transmit traction and braking forces from bolster cross member brackets 87U and 87L to lever parts 73U and 73L and by virtue of the vertical spacing of parallel links 85U and 85L maintain lever hub 75 normal to the bolster. Since post 71 depending from body underframe U is prevented from tipping with respect to lever hub 75 by reason of the vertical spacing of bearings 77, bolster side members 66 are maintained at all times in parallelism longitudinally of the vehicle with the underframe, thus assuring that irrespective of longitudinal tipping of the truck frame relative to the body, the effective point of traction transmission will be substantially at rail level because of the convergence near rail level of the normals to pads 67. Because of the swivel mounting of lever hub 75 on post 71, the truck is free to swivel while rounding curves and because of the pivotal connections of links 85U and 85L to levers 73U and 73L and bolster cross member brackets 87U and 87L vertical, lateral and rocking movements between the body and bolster permitted by vertical and shear deflections in body support springs 70 are freely accommodated. The substantial vertical clearance between the bottom of post 71 and the top of bolster 17 is ample for maximum vertical deflections of springs 70 and eliminates the possibility of interference between the swivel mechanism and steering linkage parts, such as transverse shaft 37.

The details of the construction may be varied substantially without departing from the spirit of the invention and the exclusive use of those modifications as come within the scope of the invention are contemplated.

I claim:

1. In a railway vehicle comprising a truck having a pair of wheeled axles, truck framing supported from said axles, framing-supported structure including a transverse bolster part and a body part supported on said bolster part, springs carried by said bolster part and directly supporting said body part thereon, a generally transverse lever fulcrumed on a fixed vertical axis to one of said structure parts, transversely spaced pairs of vertically spaced longitudinally extending parallel links pivotally connected to opposite ends of said lever and extending therefrom in opposite directions longitudinally of the truck, the ends of said links remote from said lever being pivotally secured to said other structure part, fulcrum means for said transverse lever having bearing surface portions spaced apart vertically from each other substantially as far as the vertical spacing of said parallel links whereby to prevent tipping of said lever longitudinally of the truck with respect to the structure part on which said lever is fulcrumed and by the vertical spacing of said links to maintain said bolster part against longitudinal tipping with respect to said body part, said framing comprising a rigid frame, journal boxes supported on the ends of said axles, means resiliently supporting said frame on said journal boxes and permitting vertical and yawing movements of said journal boxes relative to said frame, a longitudinally extending beam supported from the journal boxes at each side of said truck, Z-linkages connecting the journal boxes at the respective sides and including generally upright levers, a transverse shaft journaled in said beams and fixed to the Z-linkage levers at the opposite sides, traction transmitting means supporting said bolster part on said frame and transmitting traction forces from said frame to said bolster effectively near rail lever whereby to minimize axle-to-axle load transference resulting from traction forces.

2. In a railway vehicle according to claim 1, said fulcrum means comprising a vertical-axis post on said one structure and said lever having a vertically-elongated hub pivotally receiving said post.

3. In a railway vehicle according to claim 2, said lever comprising a pair of vertically-spaced lever elements, the upper and lower anchor links of each pair being secured at one end to the respective upper and lower elements.

4. In a railway vehicle according to claim 3, said vertically spaced lever elements being positioned respectively above and below said bolster.

5. In a railway vehicle according to claim 4, said post being fixed to said body part, said bolster having transversely spaced side members and longitudinally spaced transverse end members surrounding said post, said ends of said links remote from said lever being connected to said bolster transverse members.

6. In a railway vehicle according to claim 5, said bolster transverse members having upstanding and depending brackets forming pivotal connections for said links, the links of each said pair being positioned respectively above and below said transverse members.

7. In a railway vehicle according to claim 6, said hub being formed with lateral projections substantially horizontally aligned with said frame side members and spaced transversely therefrom to limit lateral movements of said body with respect to said bolster.

8. In a railway vehicle comprising a truck having a pair of wheeled axles, truck framing supported from said axles, framing-supported structure including a transverse bolster part and a body part supported on said bolster part, springs carried by said bolster part and directly supporting said body part thereon, a generally transverse lever fulcrumed on a fixed vertical axis to one of said structure parts, transversely spaced pairs of vertically spaced longitudinally extending parallel links pivotally connected to opposite ends of said lever and extending therefrom in opposite directions longitudinally of the truck, the ends of said links remote from said lever being pivotally secured to said other structure part, fulcrum means for said transverse lever having bearing surface portions spaced apart vertically from each other substantially as far as the vertical spacing of said parallel links whereby to prevent tipping of said lever longitudinally of the truck with respect to the structure part on which said lever is fulcrumed and by the vertical spacing of said links to maintain said bolster part against longitudinal tipping with respect to said body part, said framing comprising a rigid frame, journal boxes supported on the ends of said axles, means resiliently supporting said frame on said journal boxes and permitting vertical and yawing movements of said journal boxes relative to said frame, a longitudinally extending beam supported from the journal boxes at each side of said truck, Z-linkages connecting the journal boxes at the respective sides and including generally upright levers, a transverse shaft journaled in said beams and fixed to the Z-linkage levers at the opposite sides.

9. In a railway vehicle according to claim 8, said fulcrum means comprising a vertical-axis post on said one structure part and said lever having a vertically-elongated hub pivotally receiving said post.

10. In a railway vehicle according to claim 9, said lever comprising a pair of vertically-spaced lever elements, the upper and lower anchor links of each pair being secured at one end to the respective upper and lower elements.

11. In a railway vehicle according to claim 10, said vertically spaced lever elements being positioned respectively above and below said bolster.

12. In a railway vehicle according to claim 11, said post being fixed to said body part, said bolster having transversely spaced side members and longitudinally spaced transverse end members surrounding said post, said ends of said links remote from said lever being connected to said bolster transverse members.

13. In a railway vehicle according to claim 12, said bolster transverse members having upstanding and depending brackets forming pivotal connections for said links, the links of each said pair being positioned respectively above and below said transverse members.

14. In a railway vehicle according to claim 13, said hub being formed with lateral projections substantially horizontally aligned with said frame side members and spaced transversely therefrom to limit lateral movements of said body with respect to said bolster.

15. In a railway vehicle comprising a truck having a pair of wheeled axles, truck framing supported from said axles, framing-supported structure including a transverse bolster part and a body part supported on said bolster part, springs carried by said bolster part and directly supporting said body part thereon, a generally transverse lever fulcrumed on a fixed vertical axis to one of said structure parts, transversely spaced pairs of vertically spaced longitudinally extending parallel links pivotally connected to opposite ends of said lever and extending therefrom in opposite directions longitudinally of the truck, the ends of said links remote from said lever being pivotally secured to said other structure part, fulcrum means for said transverse lever having bearing surface portions spaced apart vertically from each other substantially as far as the vertical spacing of said parallel links whereby to prevent tipping of said lever longitudinally of the truck with respect to the structure part on which said lever is fulcrumed and by the vertical spacing of said links to maintain said bolster part against longitudinal tipping with respect to said body part.

16. In a railway vehicle according to claim 15, said one structure part having a vertical-axis post and said lever having a vertically-elongated hub pivotally receiving said post.

17. In a railway vehicle according to claim 16, said lever comprising a pair of vertically-spaced lever elements, the upper and lower anchor links of each pair being secured at one end to the respective upper and lower element.

18. In a railway vehicle according to claim 17, said vertically spaced lever elements being positioned respectively above and below said bolster.

19. In a railway vehicle according to claim 18, said post being fixed to said body part, said bolster having transversely spaced side members and longitudinally spaced transverse end members surrounding said post, said ends of said links remote from said lever being connected to said bolster transverse members.

20. In a railway vehicle according to claim 19, said bolster transverse members having upstanding and depending brackets forming pivotal connections for said links, the links of each said pair being positioned respectively above and below said transverse members.

21. In a railway vehicle according to claim 20, said hub being formed with lateral projections substantially horizontally aligned with said frame side members and spaced transversely therefrom to limit lateral movements of said body with respect to said bolster.

* * * * *